US006588128B2

(12) United States Patent
Whang

(10) Patent No.: US 6,588,128 B2
(45) Date of Patent: Jul. 8, 2003

(54) BOXED AND SELF-SUPPORTIVE CALENDAR

(76) Inventor: Yoon S. Whang, 10 Agostino, Newport Beach, CA (US) 92657

( * ) Notice: Subject to any disclaimer, the term of this patent is extended or adjusted under 35 U.S.C. 154(b) by 21 days.

(21) Appl. No.: 09/848,702

(22) Filed: May 2, 2001

(65) Prior Publication Data

US 2002/0162253 A1 Nov. 7, 2002

(51) Int. Cl.[7] ..... G09D 3/04; G09D 3/00
(52) U.S. Cl. ..... 40/121; 40/107; 40/120
(58) Field of Search ..... 40/107, 119, 120, 40/121, 124.04, 124.14, 124.16, 726, 748, 750, 774

(56) References Cited

U.S. PATENT DOCUMENTS

| | | | | | |
|---|---|---|---|---|---|
| 811,486 | A | * | 1/1906 | Dunwell | 40/774 |
| 2,801,481 | A | * | 8/1957 | Dazey | 40/121 |
| 3,280,492 | A | | 10/1966 | Nichols | |
| 3,468,048 | A | | 9/1969 | Smith | |
| 3,545,115 | A | * | 12/1970 | Nichols | 40/750 |
| 3,731,415 | A | | 5/1973 | Shore | |
| 4,288,935 | A | * | 9/1981 | Cross | 40/120 |
| 4,395,056 | A | | 7/1983 | Sferragatta | |
| 4,428,555 | A | | 1/1984 | Atkins | |
| 4,696,118 | A | | 9/1987 | Cross | |
| 4,975,137 | A | | 12/1990 | Cross | |
| 5,799,423 | A | | 9/1998 | Malino | |
| 6,035,565 | A | * | 3/2000 | Capehart | 40/121 |

* cited by examiner

*Primary Examiner*—S. Joseph Morano
*Assistant Examiner*—Jason R. Bellinger
(74) *Attorney, Agent, or Firm*—DiPinto & Shimokaji, P.C.

(57) ABSTRACT

The present invention provides a boxed and self-supportive, multi-functional calendar having a cover member that supports a date element at a slanted position on a flat surface for viewing and writing notes, and also wraps around the date element for preventing information from being seen by others. The calendar also has a magnetic element, supported by the cover member, to hold metallic pieces such as paper clips for a user to keep the surrounding surface organized. The disclosed calendar is composed of a minimal number of components which simplifies the manufacturing process and lowers production costs.

53 Claims, 3 Drawing Sheets

BOXED AND SELF-SUPPORTIVE CALENDAR

BACKGROUND OF THE INVENTION

The present invention generally relates to a calendar and, more specifically, to a calendar with a cover member that supports a date element on a flat surface for display and wraps around the calendar for protection, together with a magnetic element supported by the cover member and that holds metallic pieces such as paper clips for a user to keep the surrounding surface organized.

There are a great number of calendar displays. These displays are typically made with cardboard and a plurality of calendar leaves attached by staples or stitches, or placed in pockets on a display mount. The display may be provided with some means for supporting the display. It has also been common to combine a calendar display and paper clip dispenser together to form a desk appliance to hold paper clips.

For example, U.S. Pat. No. 3,731,415 discloses a desk appliance that serves both as a paper clip dispenser and as a perpetual calendar. The desk appliance incorporates a magnetic paper clip dispenser having a cylindrical lateral wall and an annular magnet at the top for holding paper clips. The bottom of the container has an integral cylindrical extension. The extension is a mask or frame that exposes a perpetual calendar. However, the desk appliance is constructed with various types of materials and numerous pieces, making the manufacturing process complicated and time consuming. Since it is a cylindrical container, there is also no flat surface to provide a user with the ability to write notes on the calendar.

U.S. Pat. No. 4,395,056 is a note booklet with a foldable cover. The foldable cover has a first plane section, a second plane section, a third plane section, and a flap. The foldable cover is folded away from the note booklet to form a sheet and penholder, the third plane section is placed flat on the supporting surface, and the second plane section is formed at ninety degrees to the third plane section. For calendar displays on a desk or flat surface, it is usually preferred to have the calendar set in a slanted position for easy viewing against light reflection. Yet, the foldable cover for the note booklet in this patent does not evidently provide a slanted position for the note booklet.

U.S. Pat. No. 4,696,118 discloses a display mount desk calendar. The desk calendar has four connected rectangular panels with the first and second panels of the same size, the third panel is of a shorter length than the first and second panels, and the fourth panel is of a shorter length than the third panel. The calendar is formed with the third panel placed on a flat surface while the first panel is propped on the third panel, or while the first and second panels are folded to lie across the edge of the fourth panel. The desk calendar provides a ready reference for phone numbers, address or other useful information. However, without a cover, the desk calendar does not provide protection against damage.

As can be seen, there is a need for a calendar that incorporates the different functions listed above from the prior art but that is simple in design and manufacturing.

SUMMARY OF THE INVENTION

In one aspect of the present invention, a boxed and self-supportive calendar comprises a date element, a cover member that supports the date element, and a magnetic element supported by the cover element such that the magnetic element holds metallic pieces for a user. The calendar has a first configuration wherein the cover member wraps around the date element such that the date element is boxed, and the calendar also has a second configuration wherein the cover member forms a triangle to support the date element in a slanted position.

In another aspect of the present invention, a boxed and self-supportive calendar that can be viewed by a user while the calendar is on a support surface comprises a date element having a top side, a bottom side, a rear side, and a front side; a cover member that supports the date element, with the cover member having a first segment, a second segment, a third segment, and a fourth segment, the segments being oriented to one another about a plurality of fold lines; and a magnetic element supported by the cover element. The calendar has a boxed configuration wherein the cover member wraps around the date element such that the date element is boxed about the top side, bottom side, rear side and front side; and the calendar has a self-supportive configuration wherein at least three of the segments form a triangle to support the date element at an angle to the support surface.

These and other features, aspects and advantages of the present invention will become better understood with reference to the following drawings, description and claims.

DETAILED DESCRIPTION OF THE INVENTION

Although the present invention is described as a calendar, the scope of the invention is not so limited. The present invention may be useful in the general context of an apparatus for recording and/or maintaining handwritten or preprinted information such as in the form of appointments, reminder notes, and the like. In this general context, a user may desire to have the information, and specifically the medium such as paper on which the information is contained, protected from damage, such as during shipment. The user may also desire to have the information readily accessible and viewable, such as by displaying the information on a desk surface.

Figure 1A:
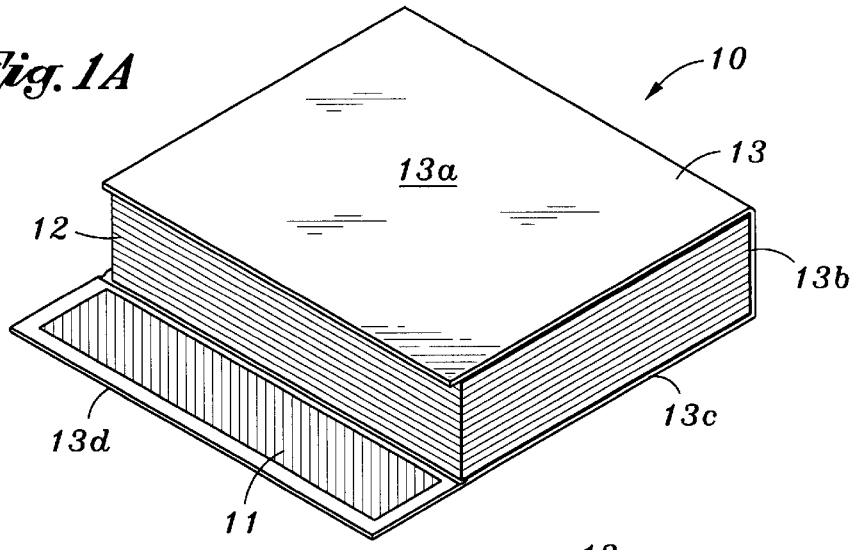
FIG. 1A is a perspective view of a calendar with a partially boxed configuration according to an embodiment of the present invention.
Figure 1B:
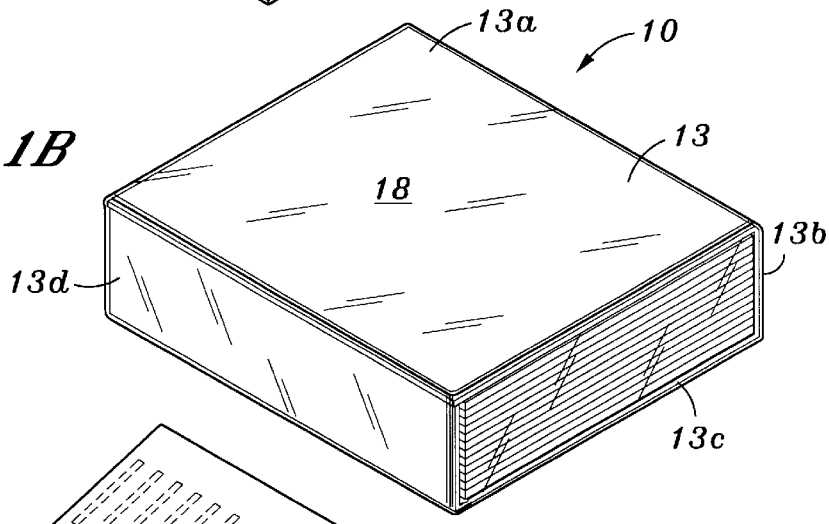
FIG. 1B is a perspective view of a calendar with a completely boxed configuration and shrink-wrapped according an embodiment of the present invention.
Figure 5:
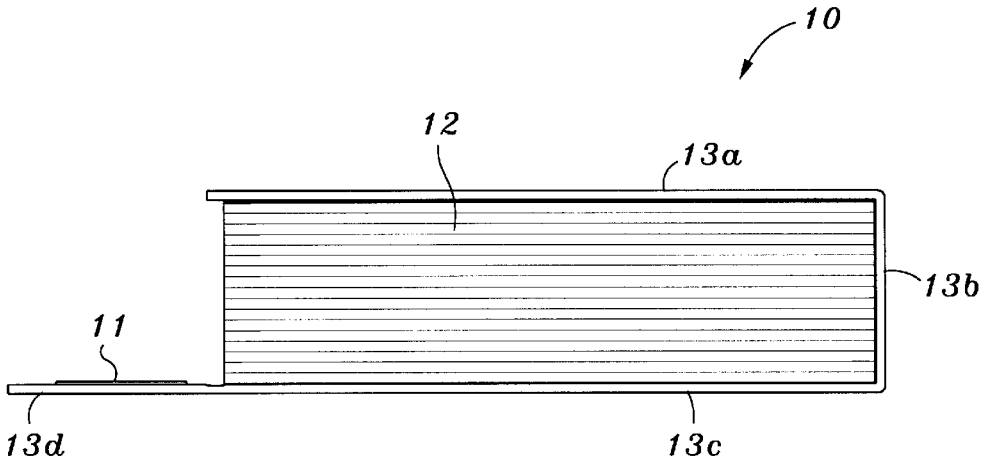
FIG. 5 is a side view of the calendar shown in FIG. 1.

FIGS. 1A and 1B are perspective views and FIG. 5 is a side view of one embodiment of the present invention. Therein, the calendar 10 may comprise a date element 12, a cover member 13 that supports the date element 12, and a magnetic element 11 that is supported by the cover member 13. The date element 12 may include an information medium, such as a plurality of paper pages, having calendar dates on them. The date element 12 can comprise a top side 12*a*, a bottom side 12*b*, a rear side 12*c*, and a front side 12*d*.

Figure 3:
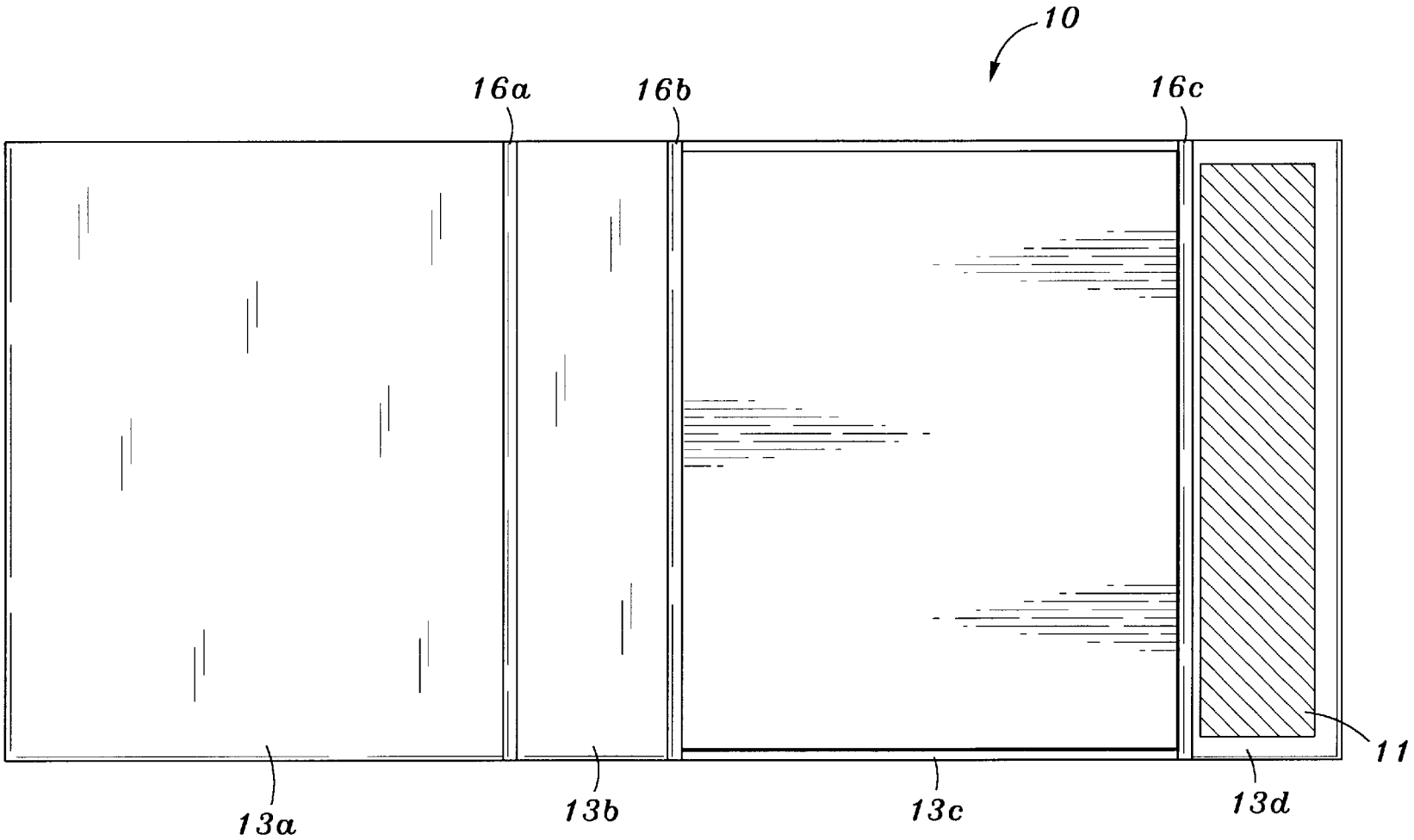
FIG. 3 is a plan view of all of the cover member segments of the calendar laid out flat according to the present invention.

The cover member 13 may be made of a protective material such as paper cardboard to protect the information medium from damage. As shown in FIG. 3, the cover member 13 can have a rectangular shape and comprise a first segment 13*a,* a second segment 13*b,* a third segment 13*c,* and a fourth segment 13*d* that may be separated by a plurality of fold lines or hinges 16*a,* 16*b,* and 16*c* that enable the segments to articulate relative to one another. The segments 13*a*–13*d* are connected in series at the fold lines 16*a*–16*d.* As shown in FIG. 3, the fold line 16*a* is between the first segment 13*a* and the second segment 13*b;* the fold line 16*b* is between the second segment 13*b* and the third segment 13*c;* and the fold line 16*c* is between the third segment 13*c* and the fourth segment 13*d.*

The segments may all be of the same shape (such as rectangular) and of the same width. In the embodiment of FIG. 3, the first segment 13*a* can have a length that is longer than a length of the second segment 13*b,* and the second segment 13*b* may have approximately the same length as the fourth segment 13*d.* The third segment 13*c* can have approximately the same length as the first segment 13*a,* which also has a longer length than the length of the second segment 13*b.* The third segment 13*c* may be affixed or secured to the bottom side 12*b* of the date element 12.

The magnetic element 11, adjacent to the date element 12, may be affixed or secured to the fourth segment 13*d* of the cover member 13 such as by gluing. The magnetic element 11 serves to hold metallic elements—such as paper clips, tacks, and straight pins—In an organized fashion while providing easy user access to such metallic elements. In the embodiment shown in the Figures, the magnetic element 11 may be of any shape, such as rectangular, and dimensioned to fit within the perimeter of the fourth segment 13*d.*

In referring again to FIGS. 1A, 1B, and 5, the calendar 10 can have a first or boxed configuration according to one embodiment of the present invention. More specifically, in FIGS. 1A and 5, the calendar 10 is shown in a partially boxed configuration inasmuch as the cover member 13 is partially open. The boxed configuration may be particularly useful in preventing damage to the date element 12, such as when the calendar 10 is being shipped or otherwise in transit. In can also be used to hide information on the date element 12 that may otherwise be in view of others. Further, the boxed configuration allows ease in shipment or other transport because, when the cover member 13 is completely closed, the calendar 10 may be easily shrink wrapped with a suitable material 18 (FIG. 1B) or placed into a shipping container, such as a cardboard box.

When the calendar 10 is in the boxed configuration, the cover member 13 may be completely or partially wrapped around the date element 12. So wrapped, the first segment 13*a* of the cover member 13 can be immediately adjacent to and interfacing the top side 12*a* of the date element 12; the second segment 13*b* of the cover member 13 can be immediately adjacent to and interfacing the rear side 12*c* of the date element 12; the third segment 13*c* can be immediately adjacent to and interfacing the bottom side 12*b* of the date element 12; and the magnetic element 11 secured to the fourth segment 13*d* of the cover member 13 can be immediately adjacent to and interfacing the front side 12*d* of the date element 12. In the first or boxed configuration, the first segment 13*a* and the second segment 13*b* of the cover member 13 can be substantially perpendicular to each other, as well as the second segment 13*b* and the third segment 13*c* of the cover member 13 being substantially perpendicular to each other. At the same time, the third segment 13*c* and the fourth segment 13*d* can be substantially parallel to each other.

Figure 2:
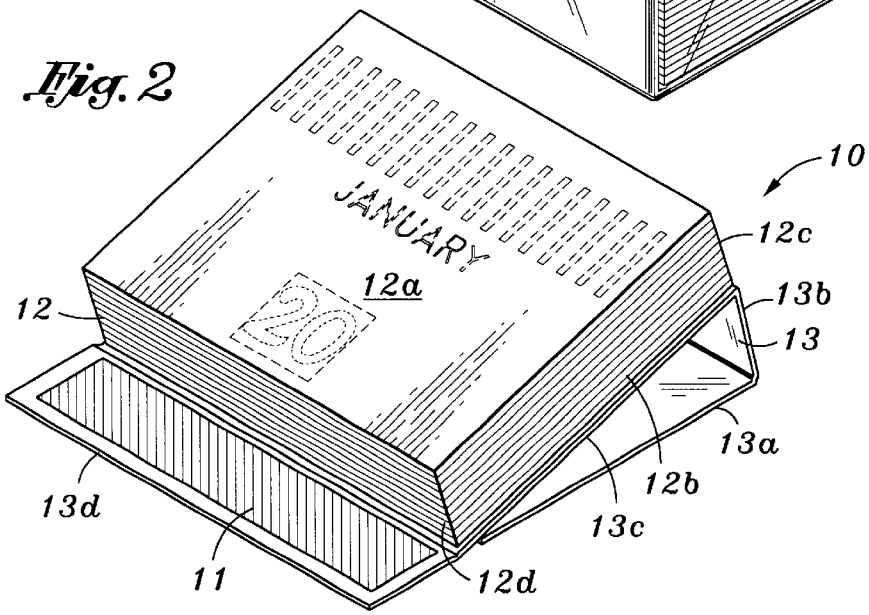
FIG. 2 is a perspective view of a calendar with a self-supportive configuration according to another embodiment of the present invention.
Figure 4:
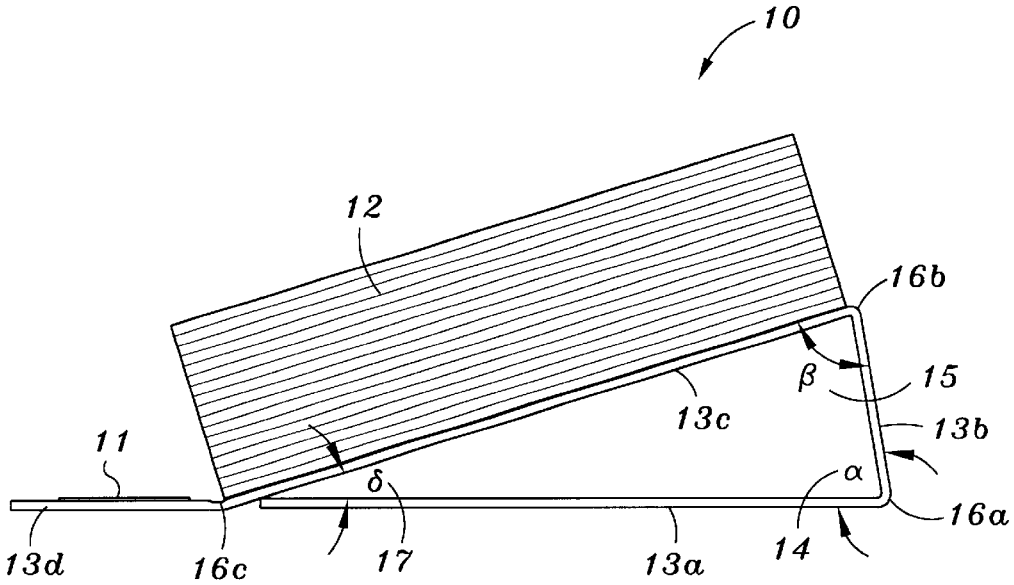
FIG. 4 is a side view of the calendar shown in FIG. 2.

FIGS. 2 and 4 are perspective and side views, respectively, of the calendar 10 having a second or self-supportive configuration according to an embodiment of the invention. When the calendar 10 is in the self-supportive configuration, a portion of the cover member 13 may be in the form of a triangle to support the date element 12 at a slant or angle δ17 to a supporting surface such as a table. The angle δ17 may be between about 25 to 35 degrees. The triangle can be formed by articulating the segments 13*a*–13*d.* For example, the first segment 13*a,* the second segment 13*b,* and the third segment 13*c* of the cover member 13 can be articulated to form the triangle with the first segment 13*a* being on the support surface. The triangle can be characterized by an angle α14, being about 75 to 85 degrees, and defined as the angle between the first segment 13*a* and the second segment 13*b* of the cover member 13. The triangle can be further characterized by an angle β 15, being about 75 to 85 degrees, and defined as the angle between the second segment 13*b* and the third segment 13*c* of the cover member 13.

In the self-supportive configuration, the magnetic element 11 may also rest flat on the support surface for holding metallic pieces such as paper clips. It can also be seen that, in the calendar 10 changing from one configuration to another, the metallic elements can remain attached to the magnetic element 11. The design simplifies the complexity of changing between two different configurations, saves time, and keeps the surrounding support surface organized.

In view of the above, it can be seen that the present invention provides a multi-functional calendar 10. The boxed and self-supportive configurations keep information on the date element 12 from being seen by others, enable easy viewing and writing on the date element 12, hold metallic pieces such as paper clips in an organized fashion, protect the date element from damage, and enable ease in packing for shipment. Also, less packaging must be discarded since an outer box is eliminated. The calendar 10 easily fits on a desk and provides a "clean" look.

It should be understood, of course, that the foregoing relates to preferred embodiments of the invention and that modifications may be made without departing from the spirit and scope of the invention as set forth in the following claims.

I claim:

1. A boxed and self-supportive calendar, comprising:

a date element;

a cover member that supports said date element;

said calendar having a first configuration wherein said cover member wraps around said date element such that said date element is boxed, whereby the cover member covers the date element; and said calendar having a second configuration wherein said cover member interchangeably forms a triangle to support said date element, where the cover member exposes the date element, whereby the calendar can be readily interchanged from the first configuration to the second configuration, and can be readily interchanged from the second configuration to the first configuration.

2. The calendar of claim 1, further comprising a magnetic element supported by said cover element, said magnetic element holds metallic pieces for a user.

3. The calendar of claim 2, wherein said magnetic element is affixed to a segment of said cover element.

4. The calendar of claim 3, wherein said magnetic element is adjacent a side of said date element.

5. The calendar of claim 4, wherein said magnetic element is adjacent a front side of said date element when said calendar is in said first configuration.

6. A boxed and self-supportive calendar, comprising:

a date element;

a cover member that supports said date element;

a magnetic element supported by said cover element, said magnetic element holds metallic pieces for a user;

said calendar having a first configuration wherein said cover member wraps around said date element such that said date element is boxed, whereby the cover member covers the date element; and said calendar having a second configuration wherein said cover member interchangeably forms a triangle to support said date element, whereby the cover member exposes the date element, whereby the calendar can be readily interchanged from the first configuration to the second configuration, and can be readily interchanged from the second configuration to the first configuration.

7. The boxed and supportive calendar of claim 6, wherein said magnetic element is adjacent a front side of said date element.

8. The boxed and self-supportive calendar of claim 6, wherein said cover member has a rectangular shape.

9. The boxed and self-supportive calendar of claim 6, wherein said cover member comprises a plurality of segments.

10. The boxed and self-supportive calendar of claim 9, wherein said cover member comprises a plurality of fold lines.

11. The boxed and self-supportive calendar of claim 10, wherein said segments are connected in series.

12. The boxed and self-supportive calendar of claim 9, wherein said segments are of rectangular shapes, each having the same width.

13. The boxed and self-supportive calendar of claim 9, wherein said plurality of segments comprise a first segment, a second segment, a third segment, and a fourth segment, said first segment having a length that is longer than a length of said second segment.

14. The boxed and self-supportive calendar of claim 13, wherein said first segment and third segment have the approximately the same lengths.

15. The boxed and self-supportive calendar of claim 13, wherein said second segment and fourth segment have the approximately the same lengths.

16. The boxed and self-supportive calendar of claim 13, wherein said date element comprises a bottom side, said bottom side being secured to said third segment of said cover member.

17. The boxed and self-supportive calendar of claim 13, wherein said magnetic element is secured to said fourth segment of said cover member.

18. The boxed and self-supportive calendar of claim 13, wherein said triangle is formed with said first segment, second segment, and third segment of said cover member.

19. A boxed and self-supportive calendar that can be viewed by a user while the calendar is on a support surface, comprising:

a date element having a top side, a bottom side, a rear side, and a front side;

a cover member that supports said date element, said cover member having a first segment, a second segment, a third segment, and a fourth segment, said segments being oriented to one another about a plurality of fold lines;

a magnetic element supported by said cover element;

said calendar having a boxed configuration wherein said cover member wraps around said date element such that said date element is boxed about a said top side, bottom side, rear side and front side, whereby the cover member covers the date element; and said calendar interchangeably having a self-supportive configuration wherein at least three of said segments form a triangle to support said date element at an angle to said support surface, whereby the cover member exposes the date element, whereby the calendar can be readily interchanged from the boxed configuration to the self-supportive configuration, and can be readily interchanged from the self-supportive configuration to the boxed configuration.

20. The boxed and self-supportive calendar of claim 19, wherein, when said calendar has said boxed configuration, said first segment of said cover member is immediately adjacent said top side of said date element.

21. The boxed and self-supportive calendar of claim 20, wherein, when said calendar has said boxed configuration, said second segment of said cover member is immediately adjacent said rear side of said date element.

22. The boxed and self-supportive calendar of claim 21, wherein, when said calendar has said boxed configuration, said third segment of said cover member is immediately adjacent said bottom side of said date element.

23. The boxed and self-supportive calendar of claim 22, wherein, when said calendar has said boxed configuration, said magnetic element is immediately adjacent said front side of said date element.

24. The boxed and self-supportive calendar of claim 19, wherein, when said calendar has said boxed configuration said first segment and said second segment of said cover member are substantially perpendicular to each other.

25. The boxed and self-supportive calendar of claim 24, wherein, when said calendar has said boxed configuration, said second segment and said third segment of said cover member are substantially perpendicular to each other.

26. The boxed and self-supportive calendar of claim 25, wherein, when said calendar has said boxed configuration, said third segment and said fourth segment of said cover member are substantially parallel to each other.

27. The boxed and self-supportive calendar of claim 19, wherein, when said calendar has said self-supportive configuration, said magnetic element is on said support surface.

28. The boxed and self-supportive calendar of claim 19, wherein, when said calendar has said self-supportive configuration, said triangle is formed by said first segment of said cover member being on said support surface.

29. The boxed and self-supportive calendar of claim 28, wherein, when said calendar has said self-supportive configuration, said triangle is characterized by an angle $\alpha$ formed between said first segment and said second segment of said cover member, said angle $\alpha$ being between about 75 to 85 degrees.

30. The boxed and self-supportive calendar of claim 29, wherein, when said calendar has said self-supportive configuration, said triangle is characterized by an angle $\beta$ formed between said second segment and said third segment of said cover member, said angle $\beta$ being between about 75 to 85 degrees.

31. The boxed and self-supportive calendar of claim 30, wherein, when said calendar has said self-supportive configuration, said date element is in a slanted position from said support surface and at angle $\delta$ between about 25 to 35 degrees.

32. The boxed and self-supportive calendar of claim 31, wherein, when said calendar has said boxed configuration, said first segment and said fourth segment of said cover member are substantially parallel to each other.

33. The boxed and self-supportive calendar of claim 19, wherein said boxed configuration covers notes on said date element.

34. The boxed and self-supportive calendar of claim 33, wherein said self-supportive configuration enables viewing and writing notes on said date element.

35. A boxed and self-supportive calendar, comprising:

a date element;

a cover member that supports said date element;

said calendar having a first configuration wherein said cover member wraps around said date element such that said date element is boxed;

said calendar having a second configuration wherein said cover member forms a triangle to support said date element; and a magnetic element supported by said cover element, said magnetic element holds metallic pieces for a user, wherein said magnetic element is affixed to a segment of said cover element, wherein said magnetic element is adjacent a side of said date element and is adjacent a front side of said date element when said calendar is in said first configuration.

36. A boxed and self-supportive calendar, comprising:

a date element;

a cover member that supports said date element;

a magnetic element supported by said cover element, said magnetic element holds metallic pieces for a user, wherein said magnetic element is adjacent a front side of said date element;

said calendar having a first configuration wherein said cover member wraps around said date element such that said date element is boxed; and said calendar having a second configuration wherein said cover member forms a triangle to support said date element.

37. A boxed and self-supportive calendar, comprising:

a date element;

a cover member that supports said date element, wherein said cover member comprises a plurality of segments, wherein said plurality of segments comprise a first segment, a second segment, a third segment, and a fourth segment, said first segment having a length that is longer than a length of said second segment, wherein said first segment and third segment have the approximately the same lengths;

a magnetic element supported by said cover element, said magnetic element holds metallic pieces for a user;

said calendar having a first configuration wherein said cover member wraps around said date element such that said date element is boxed; and said calendar having a second configuration wherein said cover member forms a triangle to support said date element.

38. A boxed and self-supportive calendar, comprising:

a date element;

a cover member that supports said date element, wherein said cover member comprises a plurality of segments, wherein said plurality of segments comprise a first segment, a second segment, a third segment, and a fourth segment, said first segment having a length that is longer than a length of said second segment, wherein said second segment and fourth segment have approximately the same lengths;

a magnetic element supported by said cover element, said magnetic element holds metallic pieces for a user;

said calendar having a first configuration wherein said cover member wraps around said date element such that said date element is boxed; and said calendar having a second configuration wherein said cover member forms a triangle to support said date element.

39. A boxed and self-supportive calendar, comprising:

a date element;

a cover member that supports said date element, wherein said cover member comprises a plurality of segments, wherein said plurality of segments comprise a first segment, a second segment, a third segment, and a fourth segment, said first segment having a length that is longer than a length of said second segment, wherein said date element comprises a bottom side, said bottom side being secured to said third segment of said cover member;

a magnetic element supported by said cover element, said magnetic element holds metallic pieces for a user;

said calendar having a first configuration wherein said cover member wraps around said date element such that said date element is boxed; and said calendar having a second configuration wherein said cover member forms a triangle to support said date element.

40. A boxed and self-supportive calendar that can be viewed by a user while the calendar is on a support surface, comprising:

a date element having a top side, a bottom side, a rear side, and a front side;

a cover member that supports said date element, said cover member having a first segment, a second segment, a third segment, and a fourth segment, said segments being oriented to one another about a plurality of fold lines;

a magnetic element supported by said cover element;

said calendar having a boxed configuration wherein said cover member wraps around said date element such that said date element is boxed about a said top side, bottom side, rear side and front side, wherein when said calendar has said boxed configuration, said first segment of said cover member is immediately adjacent said top side of said date element; and said calendar having a self-supportive configuration wherein at least three of said segments form a triangle to support said date element at an angle to said support surface.

41. The boxed and self-supportive calendar of claim 40, wherein, when said calendar has said boxed configuration, said second segment of said cover member is immediately adjacent said rear side of said date element.

42. The boxed and self-supportive calendar of claim 41, wherein, when said calendar has said boxed configuration, said third segment of said cover member is immediately adjacent said bottom side of said date element.

43. The boxed and self-supportive calendar of claim 42, wherein, when said calendar has said boxed configuration, said magnetic element is immediately adjacent said front side of said date element.

44. The boxed and self-supportive calendar of claim 40, wherein, when said calendar has said boxed configuration said first segment and said second segment of said cover member are substantially perpendicular to each other.

45. The boxed and self-supportive calendar of claim 44, wherein, when said calendar has said boxed configuration, said second segment and said third segment of said cover member are substantially perpendicular to each other.

46. The boxed and self-supportive calendar of claim 45, wherein, when said calendar has said boxed configuration, said third segment and said fourth segment of said cover member are substantially parallel to each other.

47. The boxed and self-supportive calendar of claim 40, wherein, when said calendar has said self-supportive configuration, said magnetic element is on said support surface.

48. The boxed and self-supportive calendar of claim 40, wherein, when said calendar has said self-supportive configuration, said triangle is formed by said first segment of said cover member being on said support surface.

49. The boxed and self-supportive calendar of claim 48, wherein, when said calendar has said self-supportive configuration, said triangle is characterized by an angle $\alpha$ formed between said first segment and said second segment of said cover member, said angle $\alpha$ being between about 75 to 85 degrees.

50. The boxed and self-supportive calendar of claim 49, wherein, when said calendar has said self-supportive configuration, said triangle is characterized by an angle $\beta$ formed between said second segment and said third segment of said cover member, said angle $\beta$ being between about 75 to 85 degrees.

51. The boxed and self-supportive calendar of claim 50, wherein, when said calendar has said self-supportive configuration, said date element is in a slanted position from said support surface and at angle $\delta$ between about 25 to 35 degrees.

52. The boxed and self-supportive calendar of claim 51, wherein, when said calendar has said boxed configuration, said first segment and said fourth segment of said cover member are substantially parallel to each other.

53. An apparatus for recording information comprising:

a plurality of rectangular paper pages on which information can be recorded, said plurality of pages having a top side, a rear side, a bottom side, and a front side;

a cover that comprises four rectangular segments, a top segment covering said top side, a back segment covering said back side and articulated at a fold line with said top segment, a bottom segment covering and affixed to said bottom side and articulated at a fold line with said back segment, and a front segment covering said front side and articulated at a fold line with said bottom segment; and a magnet between said front segment and said front side, secured to said front segment.

* * * * *